US008699912B2

(12) United States Patent
Kim et al.

(10) Patent No.: US 8,699,912 B2
(45) Date of Patent: Apr. 15, 2014

(54) DEVELOPING CARTRIDGE AND IMAGE FORMING APPARATUS HAVING THE SAME

(75) Inventors: Tae Hee Kim, Hwaseong-si (KR); Kyung Hwan Jang, Hwaseong-si (KR); Ju Yeong Kim, Gunpo-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 208 days.

(21) Appl. No.: 13/293,347

(22) Filed: Nov. 10, 2011

(65) Prior Publication Data

US 2012/0128387 A1 May 24, 2012

(30) Foreign Application Priority Data

Nov. 23, 2010 (KR) ..... 10-2010-0116708
Jan. 31, 2011 (KR) ..... 10-2011-0009179

(51) Int. Cl.
*G03G 21/16* (2006.01)

(52) U.S. Cl.
USPC ..... 399/110; 399/112; 399/113

(58) Field of Classification Search
USPC ..... 399/110, 111, 112, 113, 119
See application file for complete search history.

(56) References Cited

U.S. PATENT DOCUMENTS

| | | | | |
|---|---|---|---|---|
| 7,509,071 | B2 * | 3/2009 | Yoshimura et al. | 399/111 |
| 7,715,755 | B2 * | 5/2010 | Shiraki | 399/111 |
| 8,417,134 | B2 * | 4/2013 | Hosohara et al. | 399/110 X |
| 2007/0160386 | A1 * | 7/2007 | Kawamura | 399/110 |
| 2010/0202797 | A1 * | 8/2010 | Kikuchi et al. | 399/111 |

* cited by examiner

*Primary Examiner* — Sophia S Chen
(74) *Attorney, Agent, or Firm* — Stanzione & Kim, LLP

(57) ABSTRACT

A developing cartridge having a simplified mounting/separation configuration and an image forming apparatus having the same. The image forming apparatus includes a main body, a developing cartridge unit provided in the main body to form an image, a tray unit configured to accommodate the developing cartridge unit and movably mounted in the main body, a first link member movably coupled to the tray unit, and a second link member provided in the main body to be moved simultaneously with the first link member. The first link member includes a pressure piece to press the second link member such that the second link member does not interfere with the developing cartridge unit during movement of the first link member.

31 Claims, 19 Drawing Sheets

DEVELOPING CARTRIDGE AND IMAGE FORMING APPARATUS HAVING THE SAME

CROSS-REFERENCE TO RELATED APPLICATIONS

This application claims priority under 35 U.S.C. §119(a) from Korean Patent Applications No. 10-2010-0116708, filed on Nov. 23, 2010 and No. 10-2011-0009179, filed on Jan. 31, 2011 in the Korean Intellectual Property Office, the disclosures of which are incorporated herein by reference in their entirety.

BACKGROUND OF THE INVENTION

1. Field of the Invention

The present general inventive concept relates to a developing cartridge separably coupled to a main body of an image forming apparatus and an image forming apparatus having the same.

2. Description of the Related Art

A conventional image forming apparatus is designed to form an image on a print medium according to input signals. Examples of image forming apparatuses include printers, copiers, fax machines, and devices combining functions thereof.

A conventional electro-photographic image forming apparatus includes a light scanning unit and a developing cartridge unit, in which a photoconductor and a developing device are accommodated. The light scanning unit irradiates light to the photoconductor, which has been charged with a predetermined electric potential, thereby forming an electrostatic latent image on a surface of the photoconductor. The developing device feeds developer to the photoconductor on which the electrostatic latent image has been formed, thereby forming a visible image.

Such a developing cartridge unit may have various mounting configurations with respect to a main body of an image forming apparatus. In particular, in the conventional image forming apparatus including a developing cartridge unit accommodated in a tray movably coupled to a main body, a structure is included therein to prevent the developing cartridge unit from interfering with other elements arranged in the main body when the tray is moved to be mounted to or separate from the developing cartridge unit. This structure typically includes various link mechanisms to connect the tray and the main body to each other.

SUMMARY OF THE INVENTION

The present general inventive concept provides a developing cartridge having a simplified mounting/separation configuration and an image forming apparatus having the same.

Additional aspects and utilities of the present general inventive concept will be set forth in part in the description which follows and, in part, will be obvious from the description, or may be learned by practice of the general inventive concept.

The foregoing and/or other features and utilities of the present general inventive concept may be achieved by providing an image forming apparatus including a main body, a developing cartridge unit provided in the main body to form an image, a tray unit configured to accommodate the developing cartridge unit and movably mounted in the main body, a first link member movably coupled to the tray unit, and a second link member provided in the main body to be moved according to a movement of the first link member, wherein the first link member includes a pressure piece to press the second link member such that the second link member does not interfere with the developing cartridge unit during movement of the first link member.

The second link member may be pressed by the pressure piece and be moved upward or downward.

The first link member may be coupled to one side or either side of the tray unit.

The pressure piece may protrude from one surface of the first link member.

The second link member may include a guide rail to guide the pressure piece.

The guide rail may include an opening to allow the pressure piece to be introduced into the guide rail, a parallel section extending parallel to a direction in which the pressure piece is moved, and an oblique section provided at an angle with respect to the parallel section.

The pressure piece may slide along the guide rail and press the oblique section so as to move the second link member upward or downward.

The image forming apparatus may further include a guide member provided at a lateral surface of the main body, and the guide member may be arranged parallel to a direction in which the tray unit is moved, the guide member being coupled to the second link member to guide upward or downward movement of the second link member.

The guide member may include at least one guide protrusion protruding laterally from one side thereof, and the second link member may include at least one slot into which the guide protrusion is inserted.

An elastic member may be provided between the second link member and the guide member to support the second link member.

The second link member may include at least one press protrusion to press the developing cartridge unit, and the press protrusion may be provided at an upper end of the second link member.

The image forming apparatus may further include a cam member coupled to the guide member to move the guide member in a direction in which the press protrusion presses the developing cartridge unit.

The image forming apparatus may further include a cam gear connected to the cam member, a cam drive gear engaged with the cam gear to transmit power to the cam gear, and a solenoid arranged near the cam drive gear to control driving of the cam drive gear.

The foregoing and/or other features and utilities of the present general inventive concept may also be achieved by providing an image forming apparatus includes a main body, at least one developing cartridge including a photoconductor and a developing device to feed developer to the photoconductor, a cover member to open or close the main body, a tray unit coupled to the cover member and slidably mounted in the main body while supporting the at least one developing cartridge, at least one first link member provided at one side of the tray unit, and a second link member provided in the main body and having a guide rail to guide the first link member, wherein the first link member slides along the guide rail and presses the second link member.

The first link member may include a pressure piece protruding from a surface thereof.

One end of the guide rail may be open to allow the pressure piece to be introduced into the guide rail, and the other end of the guide rail may be provided with an oblique section at an angle with respect to a movement direction of the pressure piece to allow the second link member to be pressed by the pressure piece.

The second link member may be moved upward when the pressure piece is introduced into the oblique section and be moved downward when the pressure piece is separated from the oblique section.

The cover member may be slidably coupled to the tray unit, and the cover member may have a first position at which the cover member moved forward of the main body is spaced apart from the main body by a predetermined distance in a state in which the tray unit is secured to the main body and a second position to which the tray unit and the cover member are moved together from the first position forward of the main body such that the developing cartridge is separable from the tray unit.

The pressure piece may be located in the guide rail until the cover member opens the main body and is located at the first position, and be separated from the guide rail when the cover member and the tray unit are moved together forward of the main body beyond the first position.

The second link member may include a press protrusion to press the at least one developing cartridge, causing the photoconductor and the developing roller to be spaced apart from each other, and the press protrusion may be positioned to press the at least one developing cartridge when the cover member closes the main body and be positioned so as not to interfere with the at least one developing cartridge when the cover member is located at the first position.

The image forming apparatus may further include a guide member arranged parallel to a direction in which the first link member is moved, the guide member being coupled to the second link member to guide upward or downward movement of the second link member.

The second link member may include at least one vertically elongated slot, and the guide member may include at least one guide protrusion to slide along the slot.

The foregoing and/or other features and utilities of the present general inventive concept may also be achieved by providing a developing cartridge unit, which is used in an image forming apparatus including a main body and a tray unit in which the developing cartridge unit to form an image is accommodated, the tray unit being movably mounted in the main body, includes a photoconductor, a developing roller to feed developer to the photoconductor, and a bar to be pressed by a link member connecting the main body and the tray unit to each other, wherein the photoconductor and the developing roller are separated from each other when the bar is pressed and come into contact with each other when the bar is pressure-released.

The link member may include a first link member coupled to one side or either side of the tray unit and having a pressure piece protruding from a surface thereof, and a second link member connected to the first link member and having a guide rail to guide the pressure piece, and the pressure piece may slide along the guide rail so as to press the second link member.

The guide rail may include an opening provided at one end thereof to allow the pressure piece to be connected to the guide rail, a parallel section extending parallel to a direction in which the pressure piece is moved, and an oblique section provided at a predetermined angle with respect to the parallel section.

The pressure piece may press the oblique section to move the second link member in a direction perpendicular to a movement direction of the pressure piece.

The second link member may further include a press protrusion to press the bar.

The photoconductor and the developing roller may be separated from each other when the press protrusion presses the bar, and come into contact with each other when the press protrusion releases the bar.

The foregoing and/or other features and utilities of the present general inventive concept may also be achieved by providing an image forming apparatus, including a main body, including at least one slot formed on a side of the main body, and at least one guide rail formed on the side of the main body, and a tray unit slidably mounted to the main body to hold at least one detachable developing cartridge, including at least one guide protrusion slidably coupled to the at least one slot, and at least one pressure piece slidably coupled to the at least one guide rail, wherein the at least one guide protrusion moves within the at least one slot in a first direction during a second directional movement of the at least one pressure piece within the at least one guide rail to separate the tray unit from the main body.

The tray unit may further include at least one developing cartridge, including a photoconductor to form an image thereupon, and a developing roller to press against the photoconductor to transfer developer onto a printing medium to form the image thereupon, and at least one bar coupled to the developing cartridge to separate the photoconductor from the developing roller.

The main body may further include at least one press protrusion to press against the at least one bar to perform the separation of the photoconductor from the developing roller

BRIEF DESCRIPTION OF THE DRAWINGS

These and/or other aspects of the general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
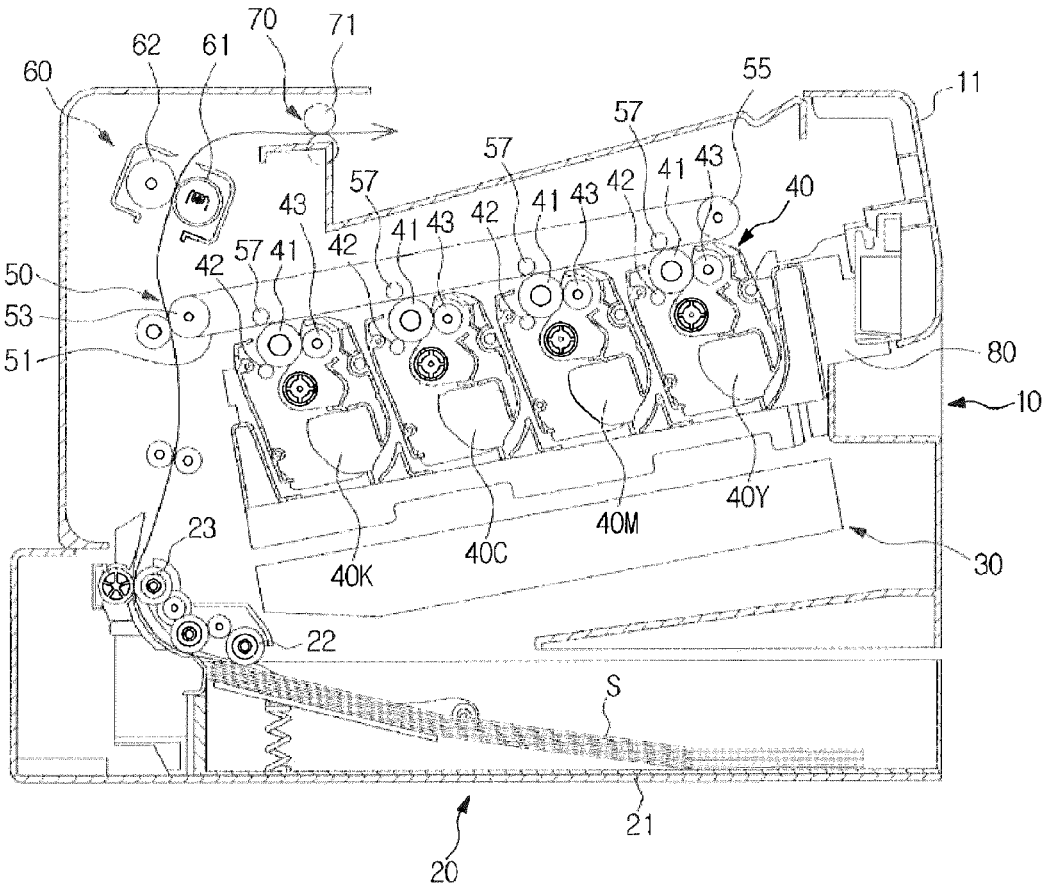
FIG. 1 is a view schematically illustrating a configuration of an image forming apparatus according to exemplary embodiments of the present general inventive concept.

Reference will now be made in detail to the embodiment of the present general inventive concept, examples of which are illustrated in the accompanying drawings, wherein like reference numerals refer to like elements throughout. The embodiments are described below in order to explain the present general inventive concept while referring to the figures.

FIG. 1 is a view schematically illustrating a configuration of an image forming apparatus 1 according to an exemplary embodiment of the present general inventive concept.

As illustrated in FIG. 1, the image forming apparatus 1 includes a main body 10, a printing medium feeding unit 20, a light scanning unit 30, a developing cartridge unit 40, a transfer unit 50, a fusing unit 60, a printing medium discharge unit 70, and a tray unit 80.

The main body 10 defines an external appearance of the image forming apparatus 1 and supports a variety of elements installed therein. The main body 10 is provided at one side thereof with a slidable cover member 11. The cover member 11 opens or closes a part of the main body 10 so as to allow a user to access the interior of the main body 10 when it is necessary to mount or separate various components, such as the developing cartridge unit 40.

The printing medium feeding unit 20 includes a cassette 21 in which printing media S is stored, a pickup roller 22 to pick up the printing media S stored in the cassette 21 sheet by sheet, and a delivery roller 23 to move the picked-up printing medium S toward the transfer unit 50.

The light scanning unit 30 is arranged below the developing cartridge unit 40 and irradiates light corresponding to image information to a photoconductor 41 so as to form an electrostatic latent image on a surface of the photoconductor 41.

The developing cartridge unit 40 may include four developing cartridges 40Y, 40M, 40C and 40K, in which different colors of developer, for example, yellow Y, magenta M, cyan C and black K, are accommodated respectively.

Each of the developing cartridges 40Y, 40M, 40C and 40K includes the photoconductor 41, a charging roller 42, a developing roller 43 and a feed roller (not illustrated). An electrostatic latent image is formed on the surface of the photoconductor 41 by the light scanning unit 30. The charging roller 42 charges the photoconductor 41 with a predetermined electric potential. The feed roller (not illustrated) feeds developer to the developing roller 43, and the developing roller 43 attaches the developer to the surface of the photoconductor 41 on which the electrostatic latent image has been formed, thereby forming a visible image.

The transfer unit 50 may include a transfer belt 51, which circulates in contact with the photoconductors 41 of the respective developing cartridges 40Y, 40M, 40C and 40K, a drive roller 53 to drive the transfer belt 51, a tension roller 55 to apply predetermined tension to the transfer belt 51, and four rollers 57 to transfer visible images developed on the photoconductors 41 of the respective developing cartridges 40Y, 40M, 40C and 40K to the printing medium S.

The fusing unit 60 includes a heating roller 61 containing a heat source and a pressure roller 62 installed opposite the heating roller 61. When the printing medium S passes between the heating roller 61 and the pressure roller 62, the image is fixed to the printing medium S by heat transferred from the heating roller 61 and pressure between the heating roller 61 and the pressure roller 62.

The printing medium discharge unit 70 includes a plurality of discharge rollers 71 to discharge the printing medium S, having passed through the fusing unit 60, to a location outside of the main body 10.

Figure 2:
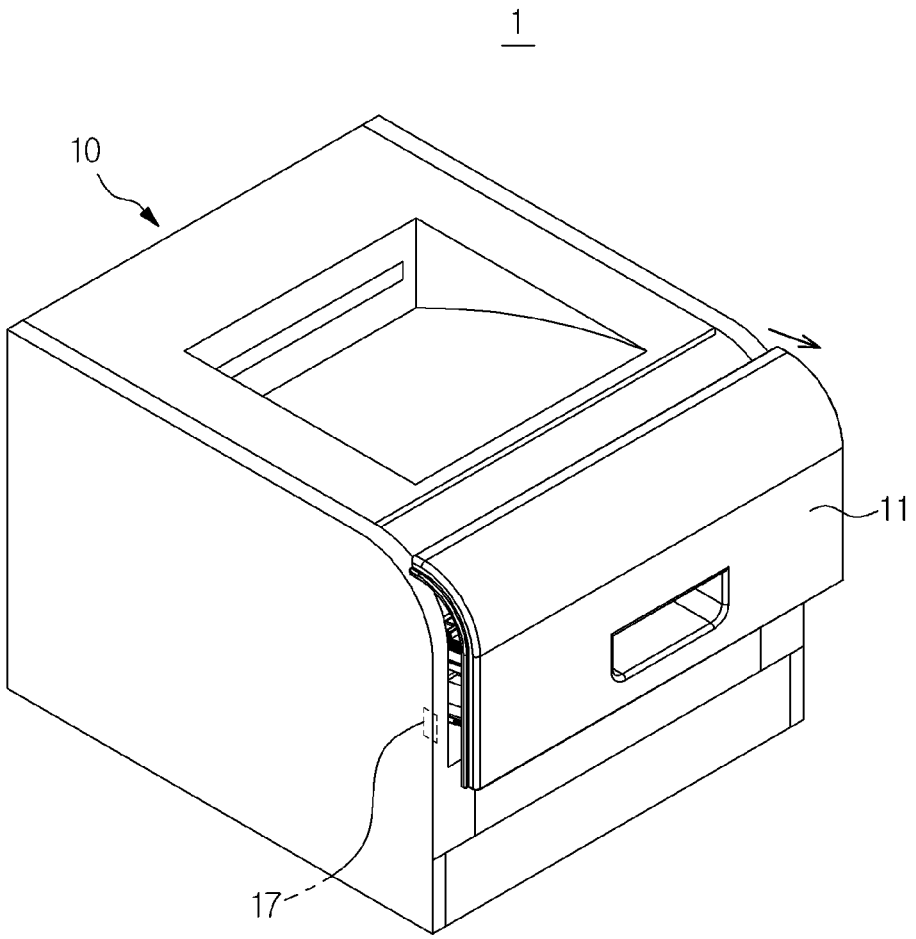
FIG. 2 is a perspective view illustrating a first position of a cover member according to an exemplary embodiment of the present general inventive concept.
Figure 3:
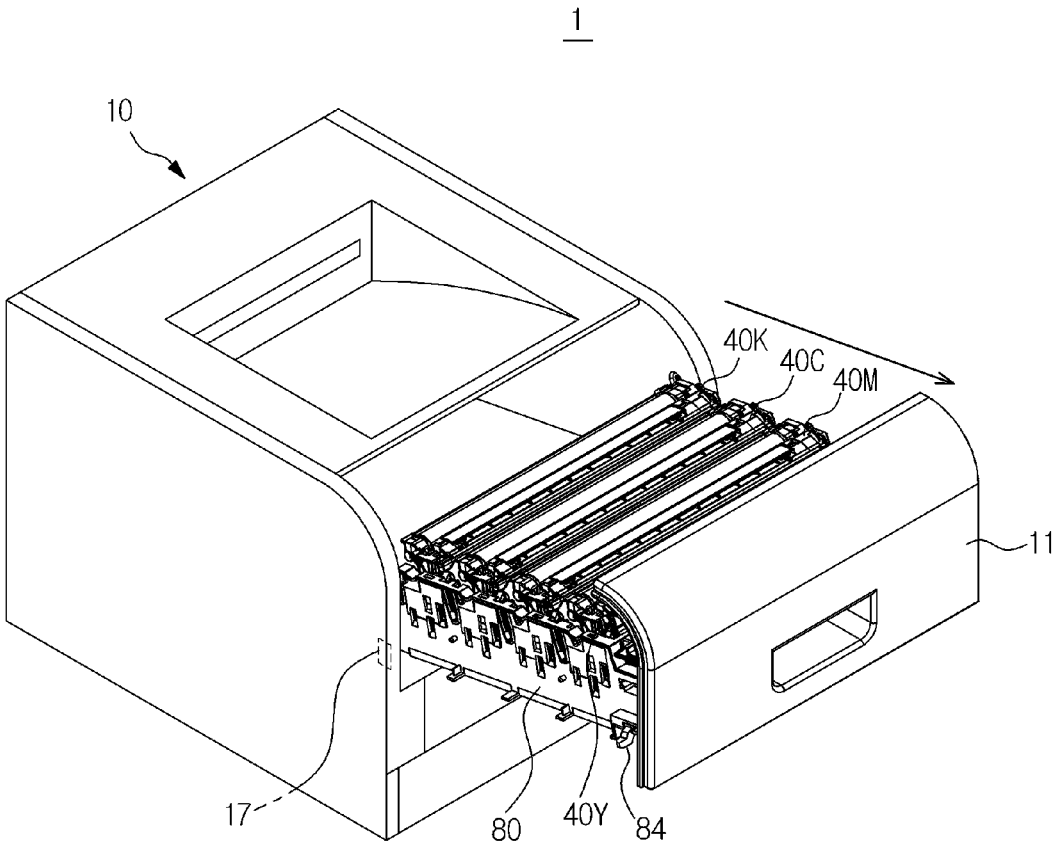
FIG. 3 is a perspective view illustrating a second position of a cover member according to an exemplary embodiment of the present general inventive concept.
Figure 4:
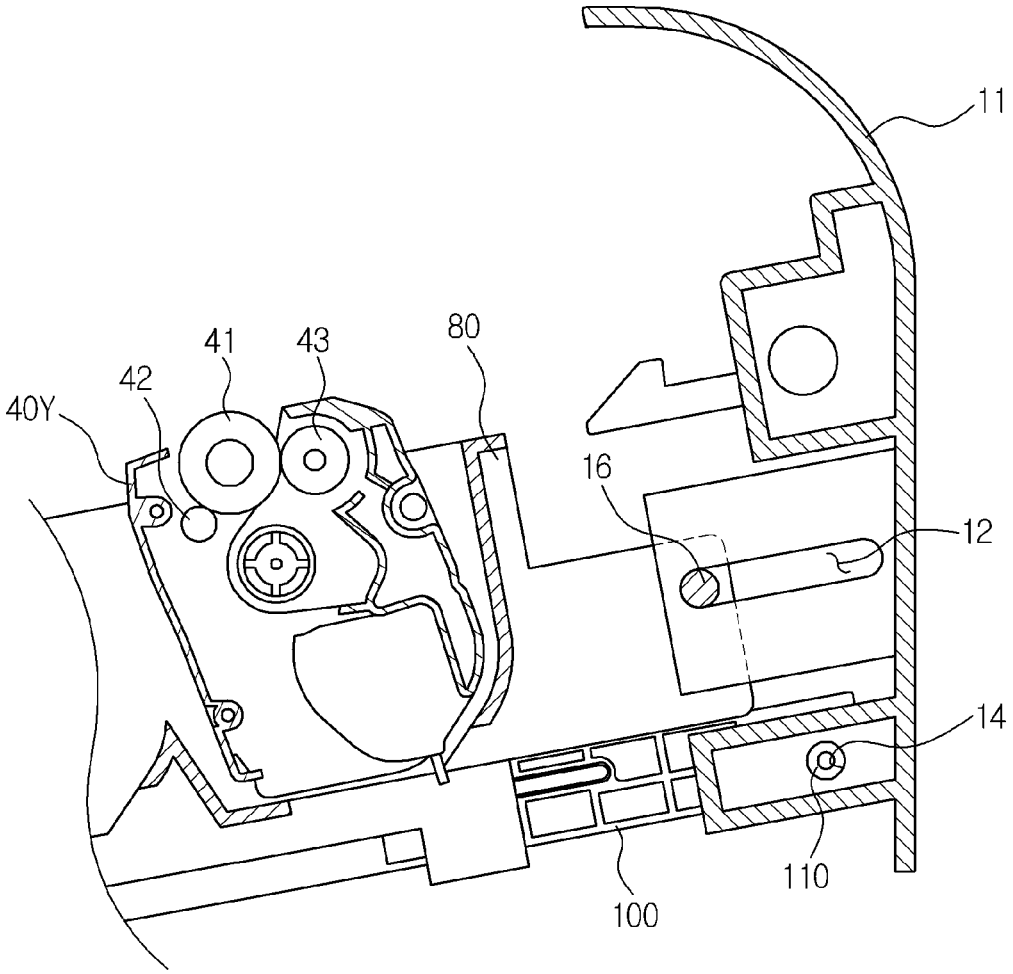
FIG. 4 is a side view illustrating a connective relationship between a cover member and a tray unit according to an exemplary embodiment of the present general inventive concept.

FIG. 2 is a perspective view illustrating a first position of the cover member 11, and FIG. 3 is a perspective view illustrating a second position of the cover member 11. FIG. 4 is a side view illustrating a connective relationship between the cover member 11 and the tray unit 80.

As illustrated in FIGS. 2 through 4, the tray unit 80 is slidably installed in the main body 10 so as to be pushed into or pulled from one side of the main body 10, and accommodates the developing cartridges 40Y, 40M, 40C and 40K therein to mount the respective developing cartridges 40Y, 40M, 40C and 40K within the main body 10. The cover member 11 used to open or close the main body 10 is slidably coupled to the tray unit 80.

Referring to FIG. 4, the cover member 11 is provided with an elongated hole shaped slider 12 extending in a direction in which the cover member 11 opens the main body 10 and a fixing hole 14 into which a fixing piece 110 of a first link member 100 is fitted. The tray unit 80 includes rails (not illustrated) engaged with opposite lateral sides of the main body 10 and a sliding rod 16 inserted into the slider 12.

The coupling of the slider 12 to the sliding rod 16 allows the cover member 11 to be slidable relative to the tray unit 80 to open and/or close the main body 10. Also, the coupling of the fixing hole 14 to the fixing piece 110 of the first link member 100 allows the cover member 11 to be moved simultaneously with respect to a movement of the first link member 100.

The tray unit 80 is slidably coupled to the main body 10 by the rails (not illustrated). The sliding rod 16 serves to guide movement of the cover member 11 such that the cover member 11 is slidably coupled to the tray unit 80.

FIG. 2 illustrates a state in which the cover member 11 is spaced slightly apart from the main body 10 by a predetermined distance when a user desires to replace the developing cartridge unit 40 (the first position). The term 'forward' may be used to describe a direction in which the cover member 11 is slid away from the main body 10, and the term 'backward' may be used to describe a direction in which the cover member 11 is slid back towards the main body 10.

Referring to FIGS. 2 and 3, the tray unit 80 is secured to the main body 10 until the cover member 11 is moved to open the main body 10 and reaches the first position. Specifically, the cover member 11 reaches the first position by sliding from the tray unit 80 by a predetermined distance according to the movement of the first link member 100. The tray unit 80 may move together with the first link member 100, and the tray unit may be moved simultaneously with the link member 100. To secure the tray unit 80 to the main body 10 until the cover member 11 is located at the first position, a knock-up tray 84 is provided at one side of the tray unit 80. A detailed description of the knock-up tray 84 will follow.

The predetermined distance between the cover member 11 and the main body 10 when the cover member 11 is located at the first position may be 40 mm.

FIG. 3 illustrates a state in which the cover member 11 is slid further away from the main body 10 to be located, along with the tray unit 80, at the second position. Once the cover member 11 and the tray unit 80 are located at the second position, replacing the respective developing cartridges 40Y, 40M, 40C and 40K is possible.

If the cover member 11 is moved to a location that is further from the main body 10 than the first position, the tray unit 80 is released from the main body 10 and remains slidable. Thus, the tray unit 80 and the cover member 11 are moved together to a location further away from the main body 10 to reach the second position. The principle of releasing the tray unit 80 will be described later upon description of the principle of securing the tray unit 80 to the main body 10.

Figure 5:
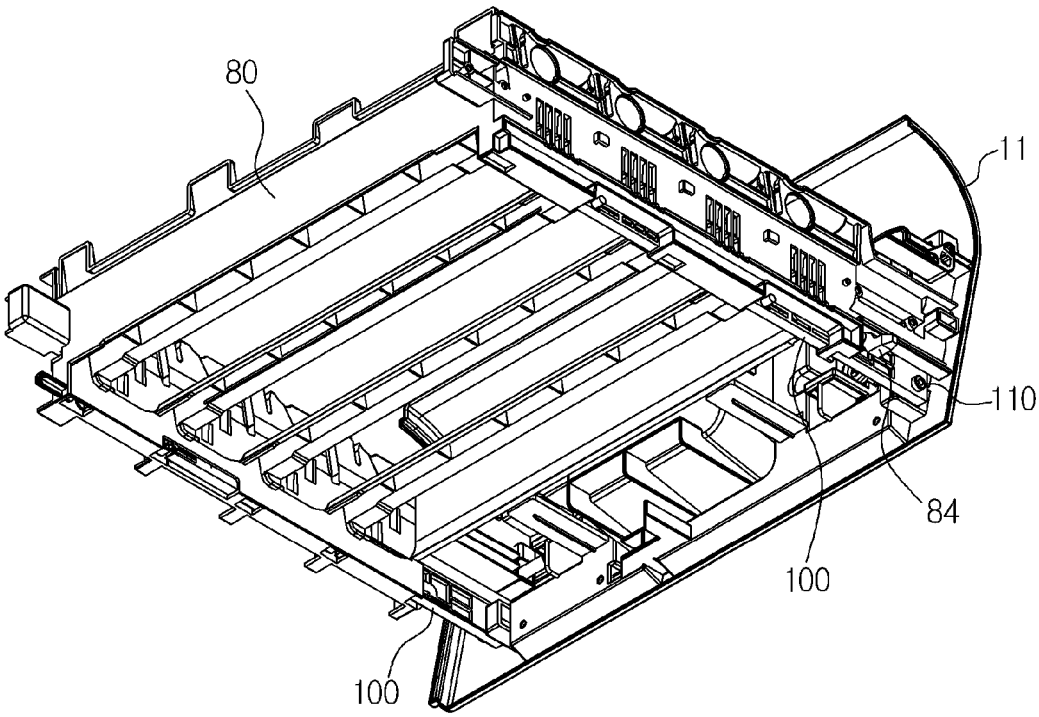
FIG. 5 is a perspective view illustrating the tray unit and a first link member according to an exemplary embodiment of the present general inventive concept.
Figure 6:
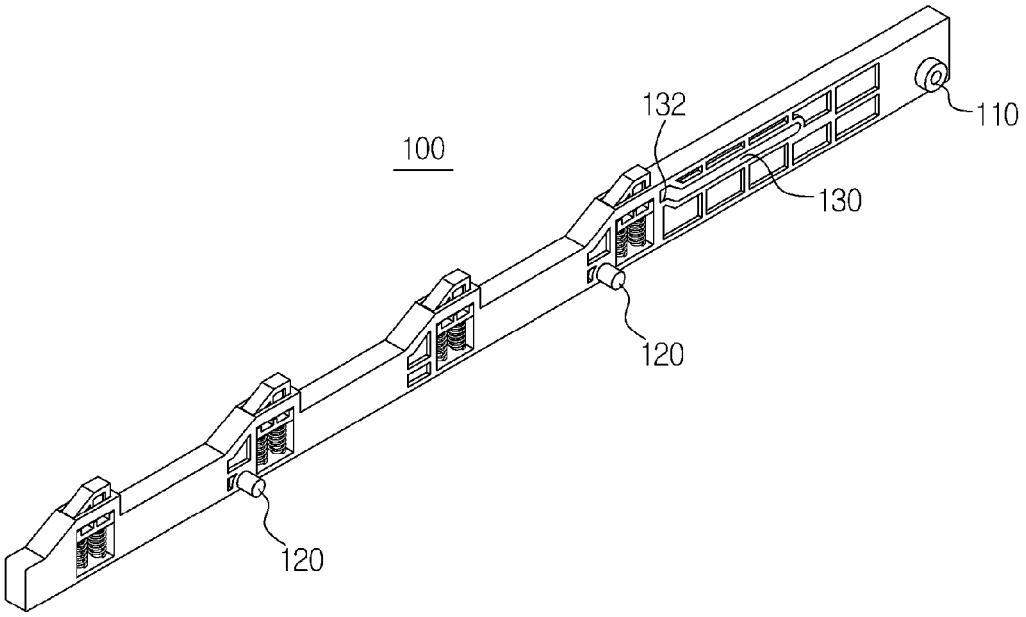
FIG. 6 is a perspective view illustrating the first link member of FIG. 5.
Figure 7:
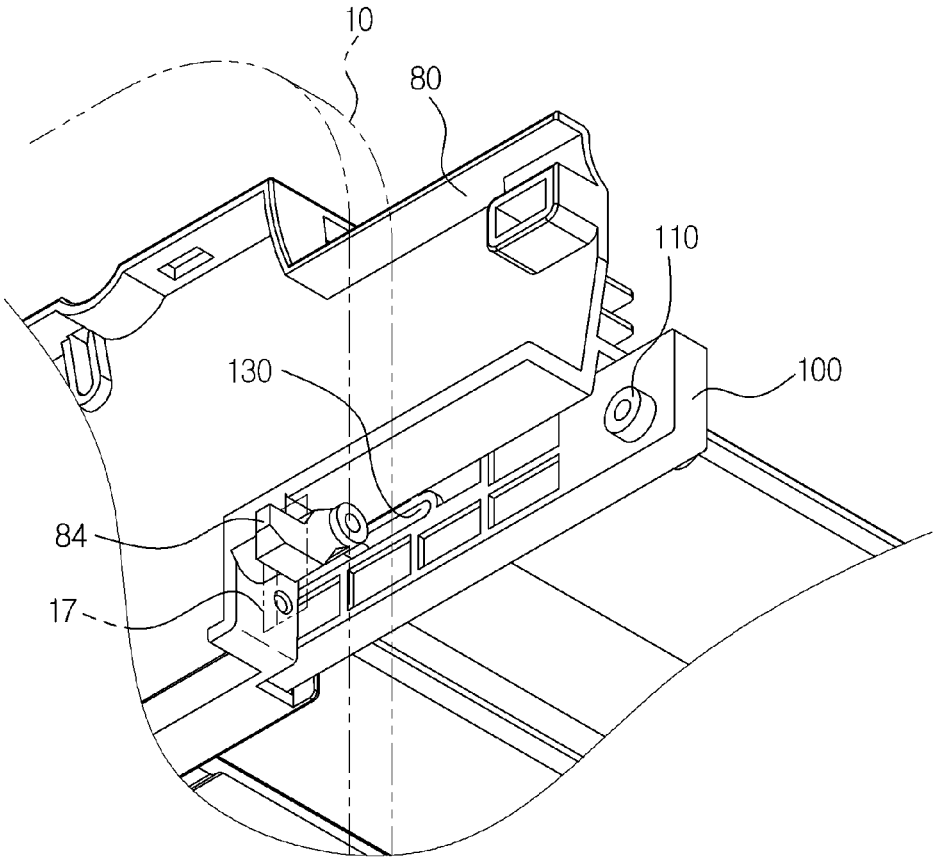
FIG. 7 is a perspective view illustrating a connective relationship between a knock-up tray and a main body according to an exemplary embodiment of the present general inventive concept.

FIG. 5 is a perspective view illustrating the tray unit 80 and the first link member 100, FIG. 6 is a perspective view illustrating the first link member 100 of FIG. 5, and FIG. 7 is a perspective view illustrating a connective relationship between the knock-up tray 84 and the main body 10.

As illustrated in FIG. 5, the first link member 100 is coupled to a lower end of either side of the tray unit 80 to be forwardly or backwardly moveable with respect thereto. The first link member 100 is coupled to the cover member 11 using the fixing piece 110 so as to be moved simultaneously with respect to the movement of the cover member 11. The tray unit 80 serves to guide the movement of the first link member 100 when the first link member 100 is moved simultaneously with respect to the movement of the cover member 11.

As illustrated in FIG. 6, the first link member 100 includes the fixing piece 110, pressure pieces 120 protruding from a surface thereof, and a guide groove 130 defined in the surface thereof to guide the knock-up tray 84.

Figure 13:
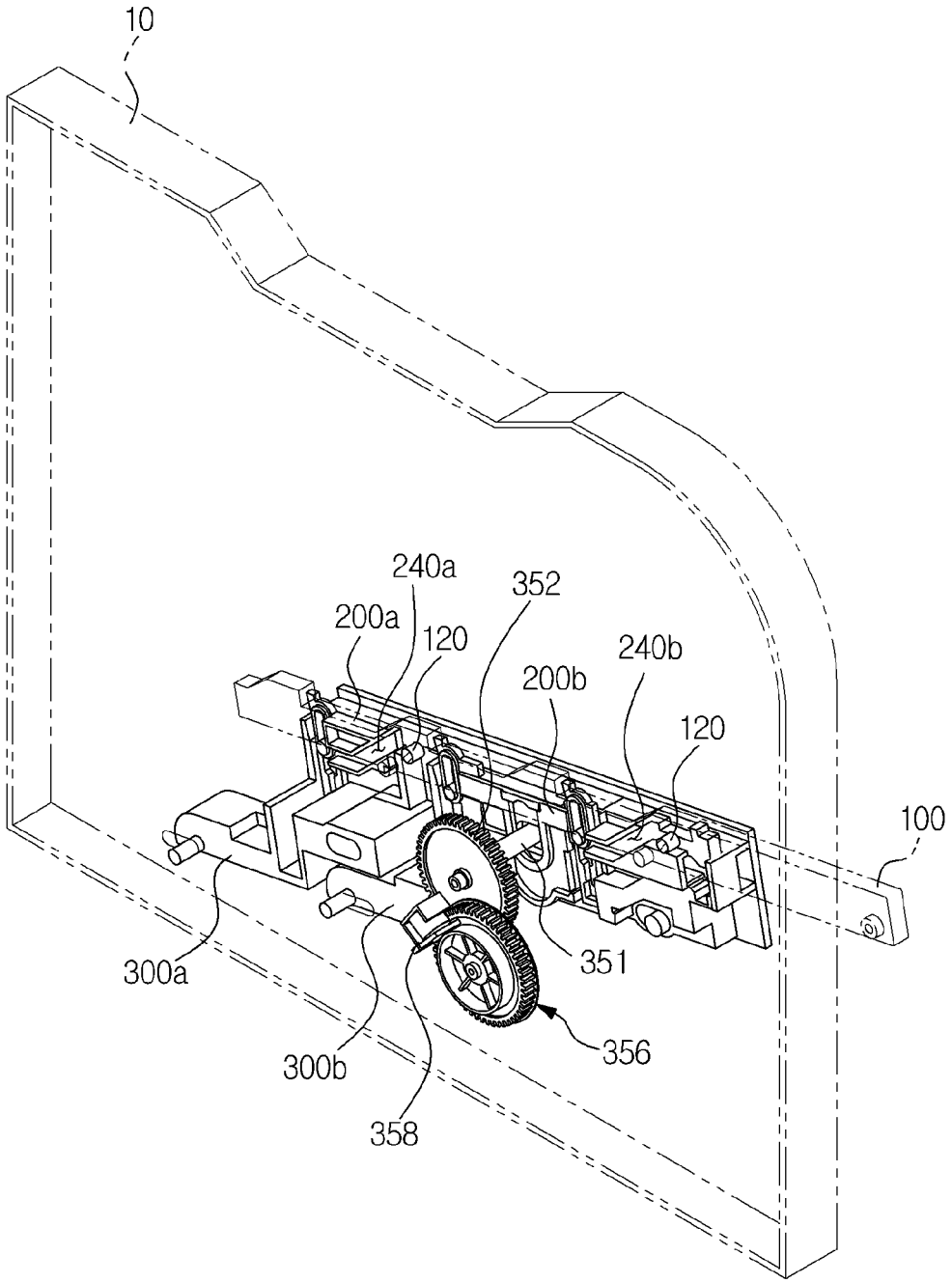
FIG. 13 is a perspective view illustrating second link members and guide members installed within the main body according to an exemplary embodiment of the present general inventive concept.

The fixing piece 110 is fitted into the fixing hole 14 of the cover member 11 to allow the first link member 100 to move along with the cover member 11. Referring to FIGS. 6 and 13, the pressure pieces 120 are coupled with second link members 200*a* and 200*b* and serve to upwardly or downwardly move the second link members 200*a* and 200*b* together with the movement of the cover member 11. The guide groove 130 is coupled with the knock-up tray 84 and has a stepped portion 132 to enable pivoting of the knock-up tray 84 when the first link member 100 is moved together with the cover member 11.

As illustrated in FIG. 7, the knock-up tray 84 is pivotally provided at one side of the tray unit 80. One end of the knock-up tray 84 may be fitted into a retaining recess 17 formed in a lateral surface of the main body 10. The other end of the knock-up tray 84 is provided with a retainer 88 to be inserted into the guide groove 130 of the first link member 100.

Hereinafter, a method of securing the tray unit 80 to the main body 10 using the knock-up tray 84 and a method of releasing the tray unit 80 to enable sliding of the tray unit 80 will be described.

Figure 8:
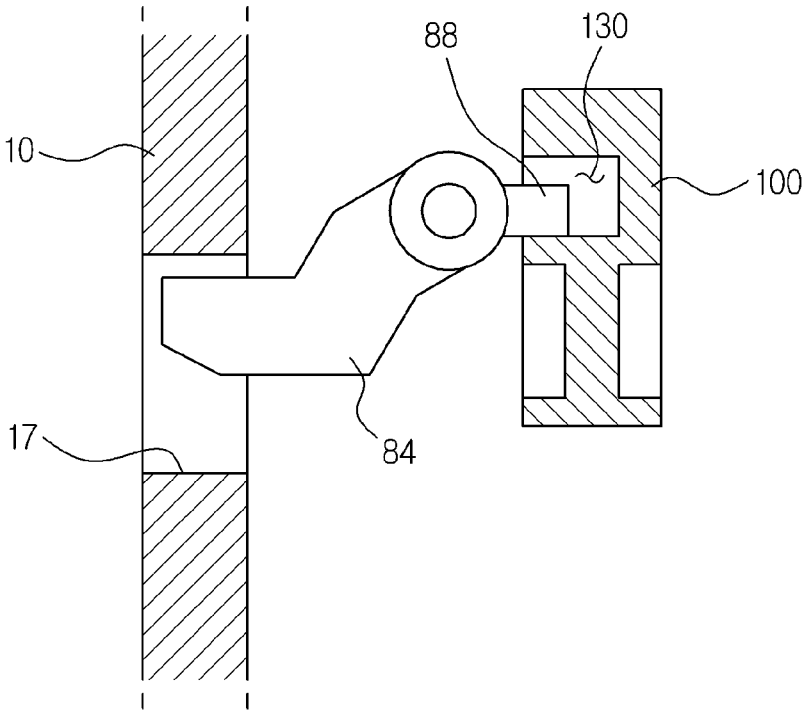
FIG. 8 is a view illustrating the knock-up tray coupled to the main body according to an exemplary embodiment of the present general inventive concept.
Figure 9:
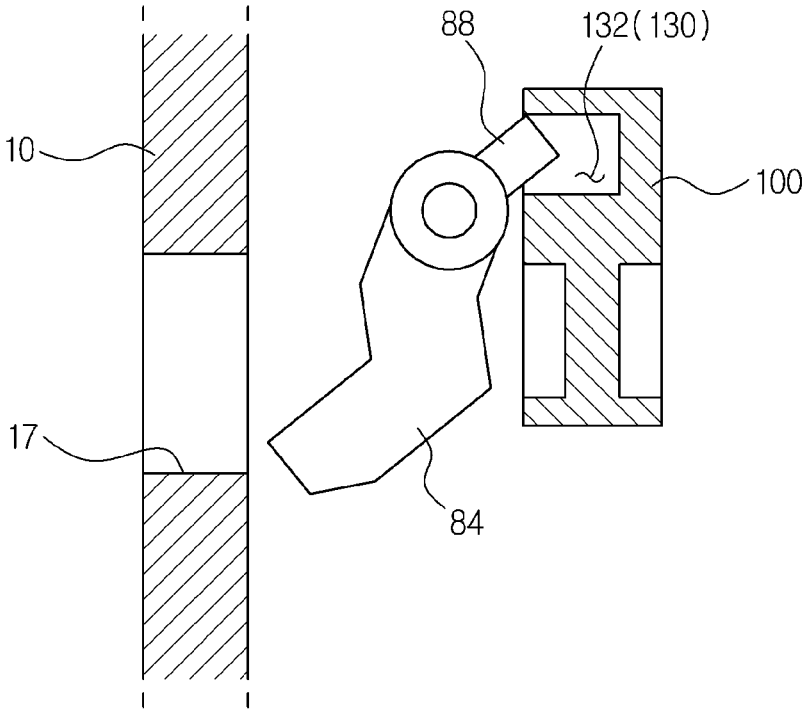
FIG. 9 is a view illustrating the knock-up tray separated from the main body according to an exemplary embodiment of the present general inventive concept.

FIG. 8 is a view illustrating the knock-up tray 84 coupled to the main body 10, and FIG. 9 is a view illustrating the knock-up tray 84 separated from the main body 10.

As illustrated in FIG. 8, one end of the knock-up tray 84 is inserted within the retaining recess 17 formed in the lateral surface of the main body 10 until the cover member 11 of FIG. 2 is moved to the first position in a state in which the cover member 11 closes the main body 10. Here, the retainer 88, which is provided at the other end of the knock-up tray 84, is in a first pivoted position and is located within the guide groove 130.

The knock-up tray 84 is coupled to the tray unit 80 to enable only pivoting thereof and therefore, allows the tray unit 80 to be secured to the main body 10 until the cover member 11 is moved to the first position.

As illustrated in FIG. 9, once the cover member 11 is located at the first position, the retainer 88, which is provided at the other end of the knock-up tray 84, is in a second pivoted position and is located in the stepped portion 132 of the first link member 100 and thus, the knock-up tray 84 is pivotable such that one end of the knock-up tray 84 is withdrawn from the retaining recess 17.

Thereby, the tray unit 80 is released from the main body 10 and is movable away from the main body 10 together with respect to the movement of the cover member 11. Then, if the cover member 11 is pulled by a user, the cover member 11 and the tray unit 80 are moved away from the main body 10 and reach the second position where the respective developing cartridges 40Y, 40M, 40C and 40K may be replaced.

With the above-described configuration, the developing cartridge unit 40 may be easily exposed and separated from the main body 10 by a single pulling operation.

Figure 10:
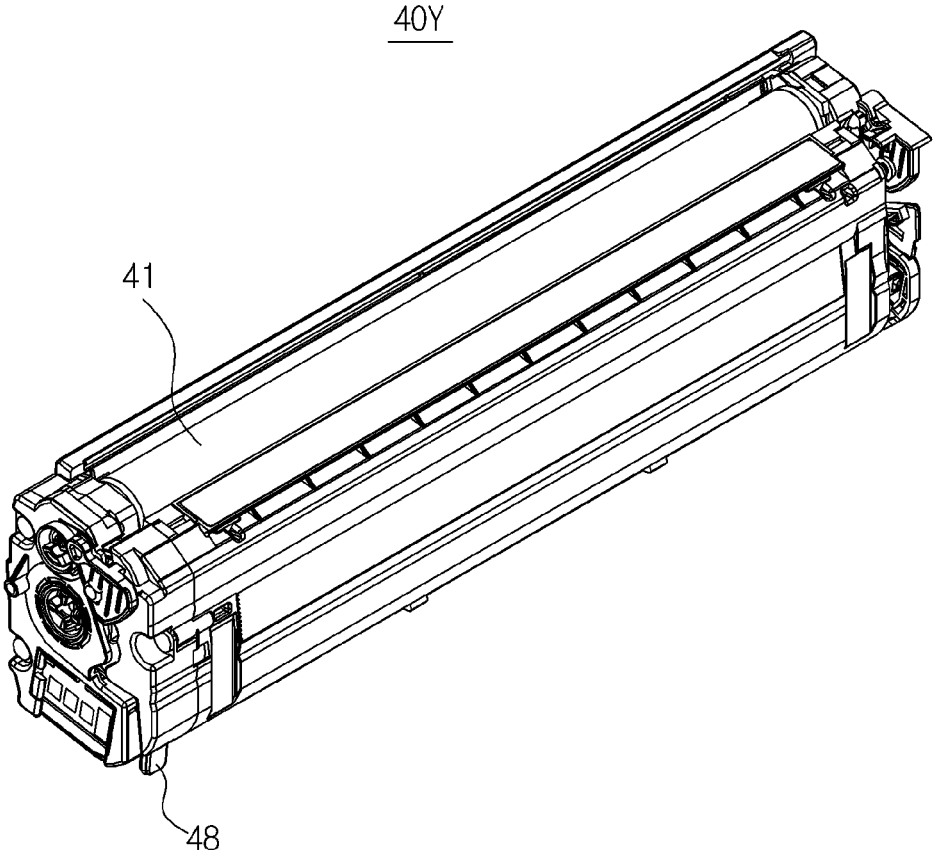
FIG. 10 is a perspective view illustrating a developing cartridge according to an exemplary embodiment of the present general inventive concept.
Figure 11:
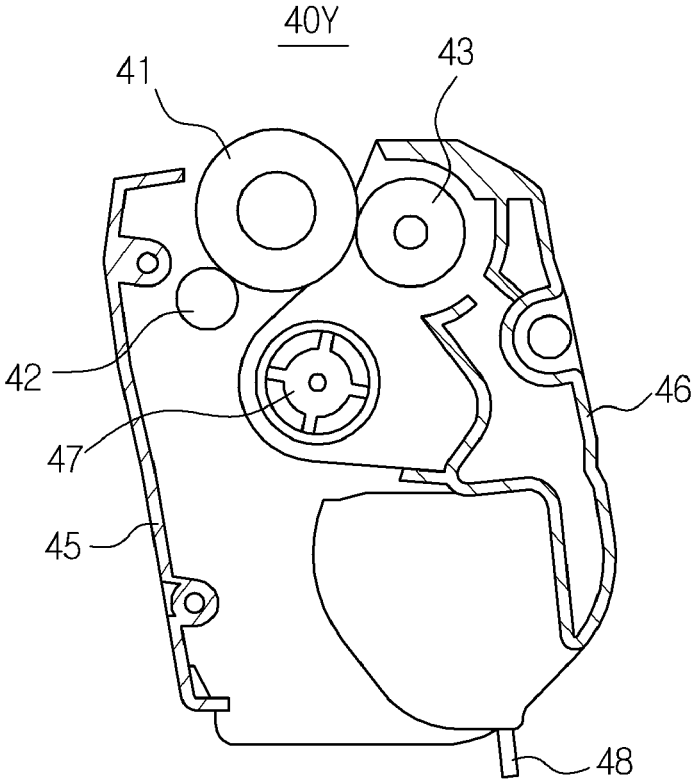
FIG. 11 is a view illustrating a photoconductor and a developing roller which come into contact with each other according to an exemplary embodiment of the present general inventive concept.
Figure 12:
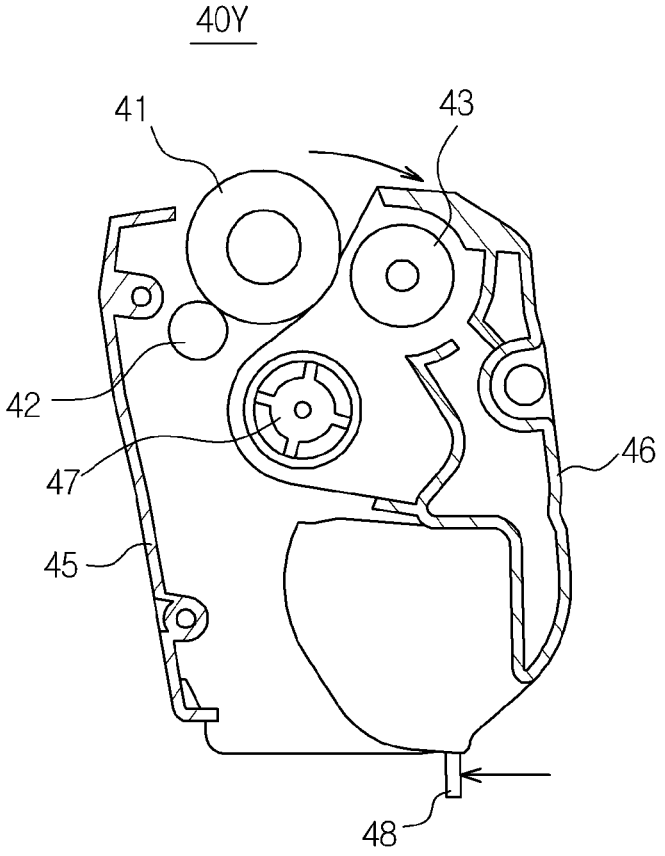
FIG. 12 is a view illustrating the photoconductor and the developing roller which are separated from each other according to an exemplary embodiment of the present general inventive concept.

FIG. 10 is a perspective view illustrating the developing cartridge 40Y, FIG. 11 is a view illustrating the photoconductor 41 and the developing roller 43 which come into contact with each other, and FIG. 12 is a view illustrating the photoconductor 41 and the developing device 43 which are separated from each other. Here, although the developing cartridge 40Y will be used specifically, it is noted that the following description may also be applied to the other developing cartridges 40C, 40M and 40K.

As illustrated in FIGS. 10 through 12, the developing cartridge 40Y mounted in the tray unit 80 includes the photoconductor 41 on the surface of which an electrostatic latent image is formed, the charging roller 42 to charge the photoconductor 41 with a predetermined electric potential, the developing roller 43 to attach developer to the surface of the photoconductor 41 on which the electrostatic latent image has been formed, a first frame 45 to rotatably support the photoconductor 41, and a second frame 46 to rotatably support the developing roller 43.

The second frame 46 is pivotally coupled to the first frame 45 via a hinge shaft 47 and is provided at a lower end thereof with a bar 48.

As illustrated in FIG. 11, the photoconductor 41 and the developing roller 43 remain in contact with each other so long as the bar 48 is not pressed. If the bar 48 is pressed in a direction designated by an arrow as illustrated in FIG. 12, the second frame 46 connected to the bar 48 is pivoted about the hinge shaft 47, causing the developing roller 43 to be separated from the photoconductor 41.

The photoconductor 41 and the developing roller 43 are arranged to come into contact with or be separated from each other because surface constituent materials of the photoconductor 41 and the developing roller 43 may be components having different hardnesses. Accordingly, if the photoconductor 41 and the developing roller 43 maintain contact with each other for a long period of time, the harder component may deform the softer component.

The bar 48 may be provided at the first frame 45. In this case, the first frame 45 is pivoted to control a positional relationship (contact or separation) between the photoconductor 41 and the developing roller 43.

Referring to FIGS. 11 through 14, the bar 48 is adapted to be pressed by press protrusions 210*a* and 210*b* provided at the second link members 200*a* and 200*b*. This will be described in detail later.

Hereinafter, a configuration and principle to prevent the developing cartridge unit 40 from interfering with other elements arranged in the main body 10 when the tray 80 is moved to mount or separate the developing cartridge unit 40 into or from the image forming apparatus 1 in accordance with the embodiment of the present general inventive concept will be described.

Figure 14:
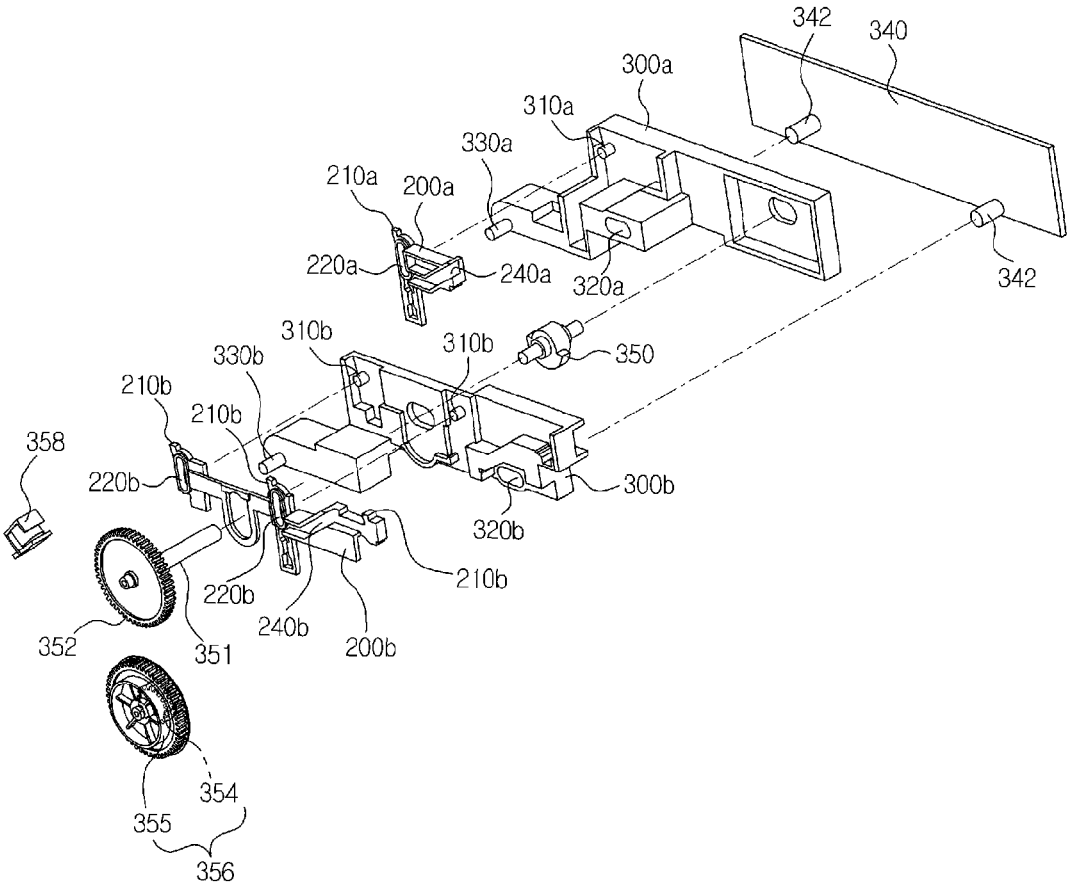
FIG. 14 is an exploded perspective view of the second link members and the guide members according to an exemplary embodiment of the present general inventive concept.

FIG. 13 is a perspective view illustrating the second link members 200*a* and 200*b* and guide members 300*a* and 300*b* coupled within the main body 10, and FIG. 14 is an exploded perspective view of the second link members 200*a* and 200*b* and the guide members 300*a* and 300*b*.

As illustrated in FIGS. 13 and 14, the guide members 300*a* and 300*b* are coupled to the lateral surface of the main body 10 so as to move in a direction parallel to the sliding direction of the tray unit 80. The second link members 200*a* and 200*b* are coupled with the guide members 300*a* and 300*b* so as to move upward or downward. The second link members 200*a* and 200*b* are provided with guide rails 240*a* and 240*b*, into which the pressure pieces 120 of the first link member 100 are slidably inserted.

The second link members 200*a* and 200*b* include the press protrusions 210 and 210*b* to press the respective developing cartridges 40Y, 40M, 40C and 40K, slots 220*a* and 220*b* into which guide protrusions 310*a* and 310*b* of the guide members 300*a* and 300*b* are inserted, and the guide rails 240*a* and 240*b* to guide the pressure pieces 120.

The press protrusions 210*a* and 210*b* protrude from upper ends of the second link members 200*a* and 200*b*, respectively.

The press protrusions 210*a* and 210*b* are arranged to press the respective developing cartridges 40Y, 40M, 40C and 40K when the second link members 200*a* and 200*b* are moved upward by the first link member 100. More specifically, the press protrusions 210*a* and 210*b* are arranged near the respective bars 48 of the developing cartridges 40Y, 40M, 40C and 40K to selectively press the bars 48 by a sliding of the second link members 200*a* and 200*b* and the guide members 300*a* and 300*b*, thereby allowing the developing roller 43 to be spaced apart from the photoconductor 41.

The slots 200*a* and 200*b* are vertically elongated to allow the second link members 200*a* and 200*b* to move upward or downward along the guide protrusions 310*a* and 310*b* provided at the guide members 300*a* and 300*b*.

The guide protrusions 310*a* and 310*b* are inserted into the slots 220*a* and 220*b* to guide movement of the second link members 200*a* and 200*b*.

The guide rails 240*a* and 240*b* are provided at a surface of the respective second link members 200*a* and 200*b* such that the pressure pieces 120 provided at the first link member 100 are inserted into the guide rails 240*a* and 240*b*. Accordingly, each of the guide rails 240*a* and 240*b* includes an opening 242*a* or 242*b* at one end thereof, a parallel section 246*a* or 246*b* extending parallel to a direction in which the pressure pieces 120 are moved, and an oblique section 244*a* or 244*b* provided at an angle with respect to the parallel section 246*a* or 246*b*.

The pressure pieces 120 slide along the guide rails 240*a* and 240*b*, thereby moving the second link members 200*a* and 200*b* upward or downward. As the pressure pieces 120 provided at the first link member 100 are may be moved along a fixed path, and the pressure pieces 120 press the second link members 200*a* and 200*b* when passing through the oblique sections 244*a* and 244*b*, causing the second link members 200*a* and 200*b* to move upward or downward by a distance equal to a height of the oblique sections 244*a* and 244*b*. By adjusting the angle between the oblique sections 244*a* and 244*b* and the parallel sections 246*a* and 246*b*, the upward or downward movement distance of the second link members 200*a* and 200*b* is adjustable.

The guide members 300*a* and 300*b* are coupled to the second link members 200*a* and 200*b* so as to guide movement of the second link members 200*a* and 200*b*. The guide members 300*a* and 300*b* include the guide protrusions 310*a* and 310*b* inserted into the slots 220*a* and 200*b*, coupling protrusions 330*a* and 330*b* coupled to the main body 10, and guide slots 320*a* and 320*b* to allow the guide members 300*a* and 300*b* to move in a direction parallel to a direction in which the tray unit 80 or the first link member 100 is moved.

The guide protrusions 310*a* and 310*b* protrude from one surface of the respective guide members 300*a* and 300*b* and are inserted into the slots 220*a* and 220*b* so as to slide along the slots 220*a* and 220*b*, thereby guiding upward or downward movement of the second link members 200*a* and 200*b*.

The coupling protrusions 330*a* and 330*b* are coupled to the main body 10 such that the guide members 300*a* and 300*b* are coupled to the main body 10 while supporting the second link members 200*a* and 200*b*.

Coupling bosses 342 protruding from a surface of a support plate 340 are inserted into the guide slots 320*a* and 320*b*, and the support plate 340 is attached to the lateral surface of the main body 10. Thus, the coupling of the coupling bosses 342 and the guide slots 320*a* and 320*b* allows the guide members 300*a* and 300*b* to be movable in a direction parallel to a direction in which the tray unit 80 or the first link member 100 is moved.

Figure 15:
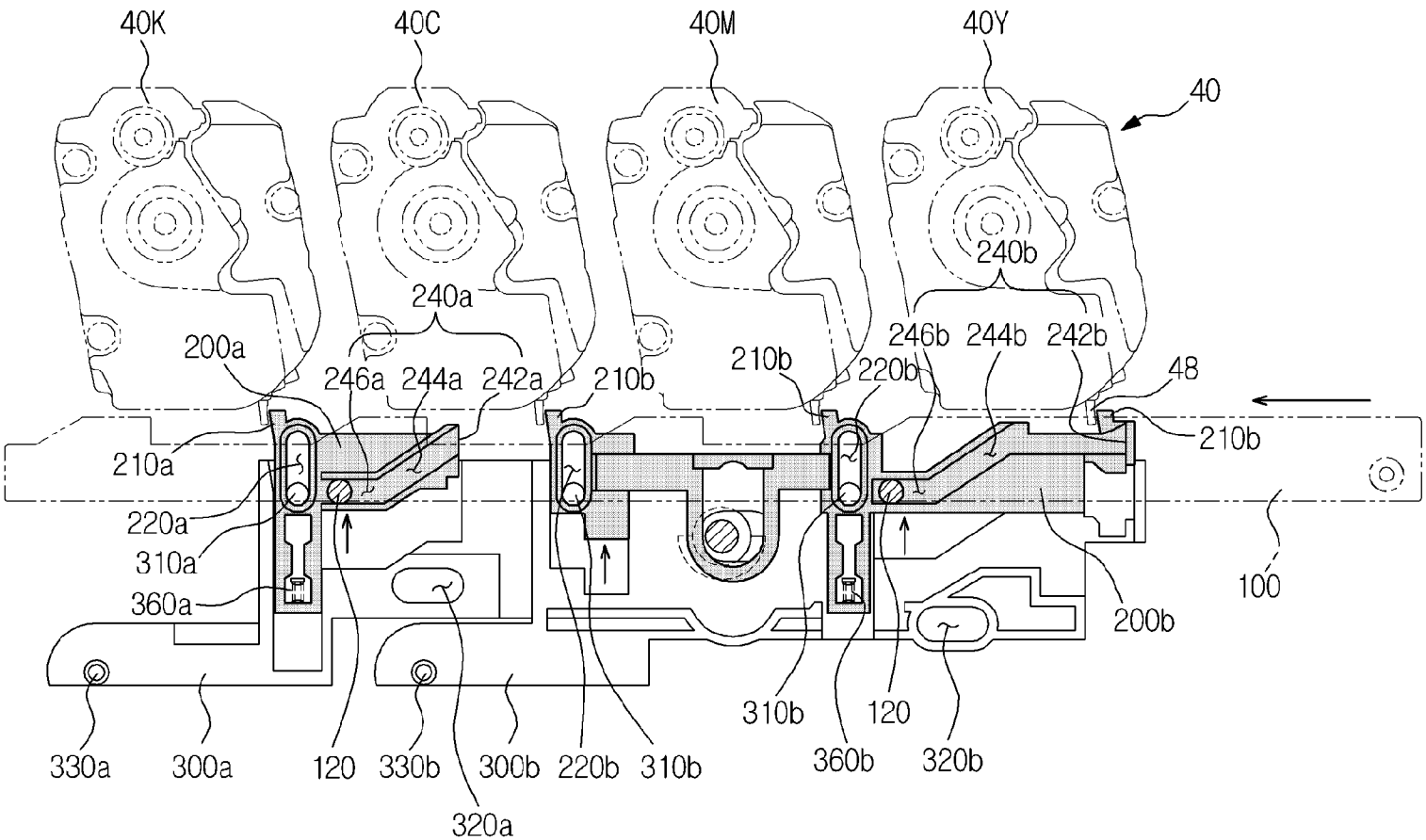
FIG. 15 is a view illustrating a positional relationship between the first link member, second link members and developing cartridge unit in a state in which the tray unit is inserted into the main body according to an exemplary embodiment of the present general inventive concept.

Referring to FIG. 15, which will be described in detail later, elastic members 360*a* and 360*b* may be provided between the second link members 200*a* and 200*b* and the guide members 300*a* and 300*b*. The elastic members 360*a* and 360*b* support the second link members 200*a* and 200*b* when the second link members 200*a* and 200*b* coupled to the guide members 300*a* and 300*b* are moved upward or downward, thereby alleviating shock applied to the second link members 200*a* and 200*b*.

A cam member 350 is interposed between the guide members 300*a* and 300*b*. The cam member 350 connects the guide members 300*a* and 300*b* to each other, allowing the guide members 300*a* and 300*b* to move in a direction parallel to a direction in which the tray unit 80 or the first link member 100 is moved.

The cam member 350 may be a double-stage cam having a plurality of profiles to enable individual or simultaneous movement of the guide members 300*a* and 300*b*. The cam member 350 is connected to a cam gear 352 via a cam shaft 351 and the cam gear 352 is driven upon receiving power from a cam drive gear 356.

The cam drive gear 356 consists of a drive transmission gear 354 engaged with the cam gear 352 to transmit rotational power and a drive control part 355 to control rotation of the cam drive gear 356. A gear ratio of the drive transmission gear 354 and the cam gear 352 is 3:1, such that the cam gear 352 engaged with the drive transmission gear 354 rotates by one-third turn when the drive transmission gear 354 rotates by one turn. The drive control part 355 is adapted to intermittently come into contact with a solenoid 358. The cam drive gear 356 is stopped when the drive control part 355 comes into contact with the solenoid 358, and is rotated when the drive control part 355 does not come into contact with the solenoid 358.

If the cam drive gear 356 is rotated by an external device (not illustrated), the cam gear 352 engaged with the drive transmission gear 354 of the cam drive gear 356 is rotated, and in turn, the cam member 350 connected to the cam gear 352 via the cam shaft 351 is rotated, causing the guide members 300*a* and 300*b* to move. The solenoid 358 presses the drive control part 355 whenever the cam drive gear 356 rotates by one turn, controlling rotation of the cam drive gear 356. As described above, since the gear ratio of the drive transmission gear 354 to the cam gear 352 is 3:1, the cam gear 352 rotates by one-third turn if the cam drive gear 356 rotates by one turn.

There may be at least three operation modes depending on positions of the guide members 300*a* and 300*b* as the cam gear 352 rotates from one third turn to one turn. The operation modes may include a ready mode in which the cam gear 352 and the cam member 350 connected to the cam gear 352 are rotated by one-third turn to move the guide members 300*a* and 300*b* from a reference position in the same direction (hereinafter, referred to as "first direction"), a color printing mode in which the cam member 350 is again rotated by one-third turn in the ready mode to move the guide members 300*a* and 300*b* in an opposite direction of the first direction (hereinafter, referred to as "second direction"), and a mono printing mode in which the cam member 350 is again rotated by one-third turn in the color printing mode to move only one guide member 300*b* in the first direction. If the cam member 350 is again rotated by one-third turn in the mono printing mode, the guide member 300*a* is moved in the first direction to reach the ready mode.

An operation to press or release the respective developing cartridges 40Y, 40M, 40C and 40K is performed by movement of the guide members 300*a* and 300*b*. A relationship between this operation and each operation mode ("ready mode", "color printing mode" or "mono printing mode") will be described later.

Hereinafter, when the cover member 11 opens or closes the main body 10 and the first link member 100 and the second link members 200*a* and 200*b* are moved simultaneously the principle of preventing the tray unit 80 from interfering with the second link members 200*a* and 200*b* when entering or exiting the main body 10 will be described. In addition, the principle of causing the second link members 200*a* and 200*b* to press the developing cartridges 40Y, 40M, 40C and 40K according to the operation mode of the image forming apparatus 1 in a state in which the tray unit 80 is completely inserted into the main body 10 will be described.

Figure 16:
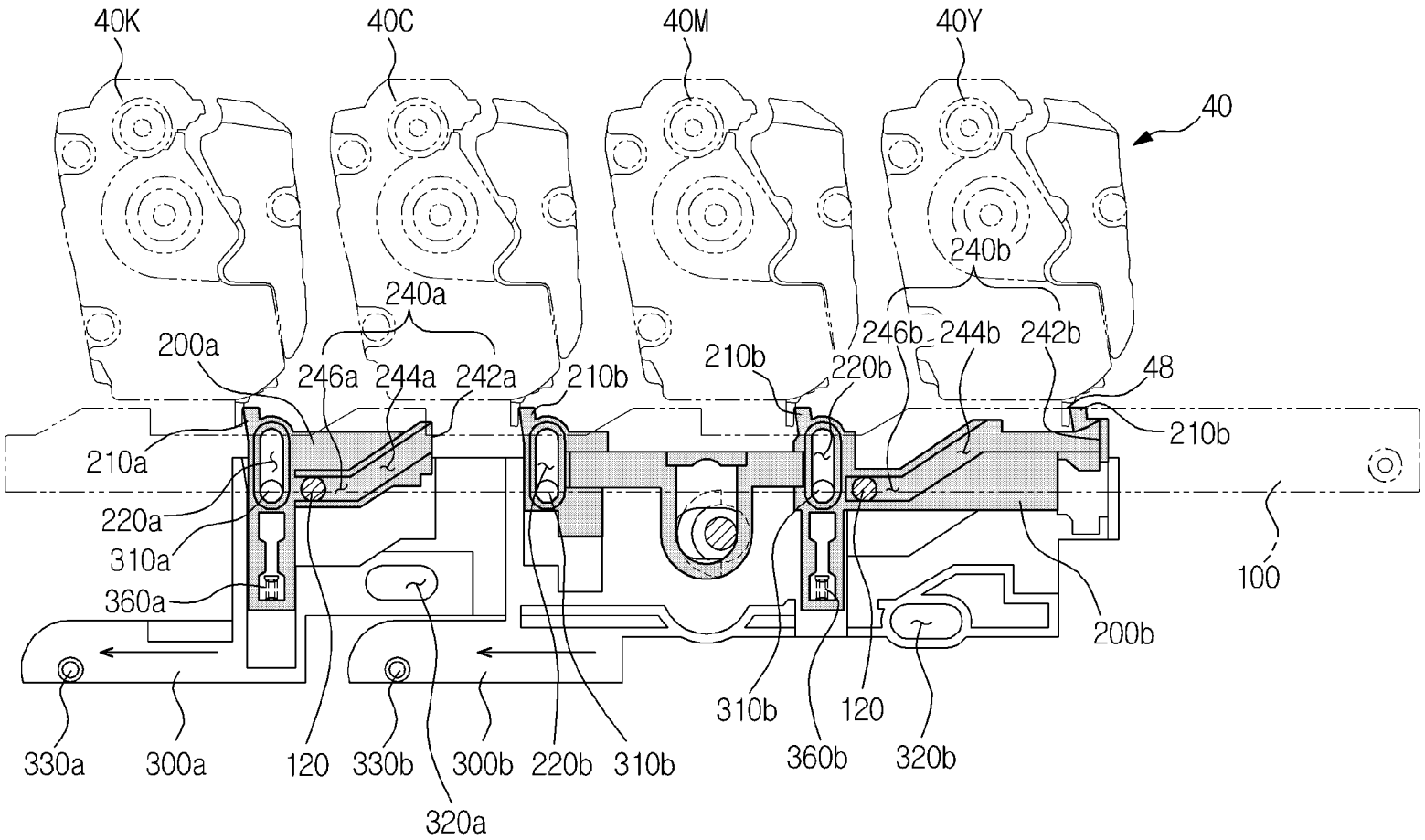
FIG. 16 is a view illustrating a state in which the developing cartridge is pressed by the second link members according to an exemplary embodiment of the present general inventive concept.
Figure 17:
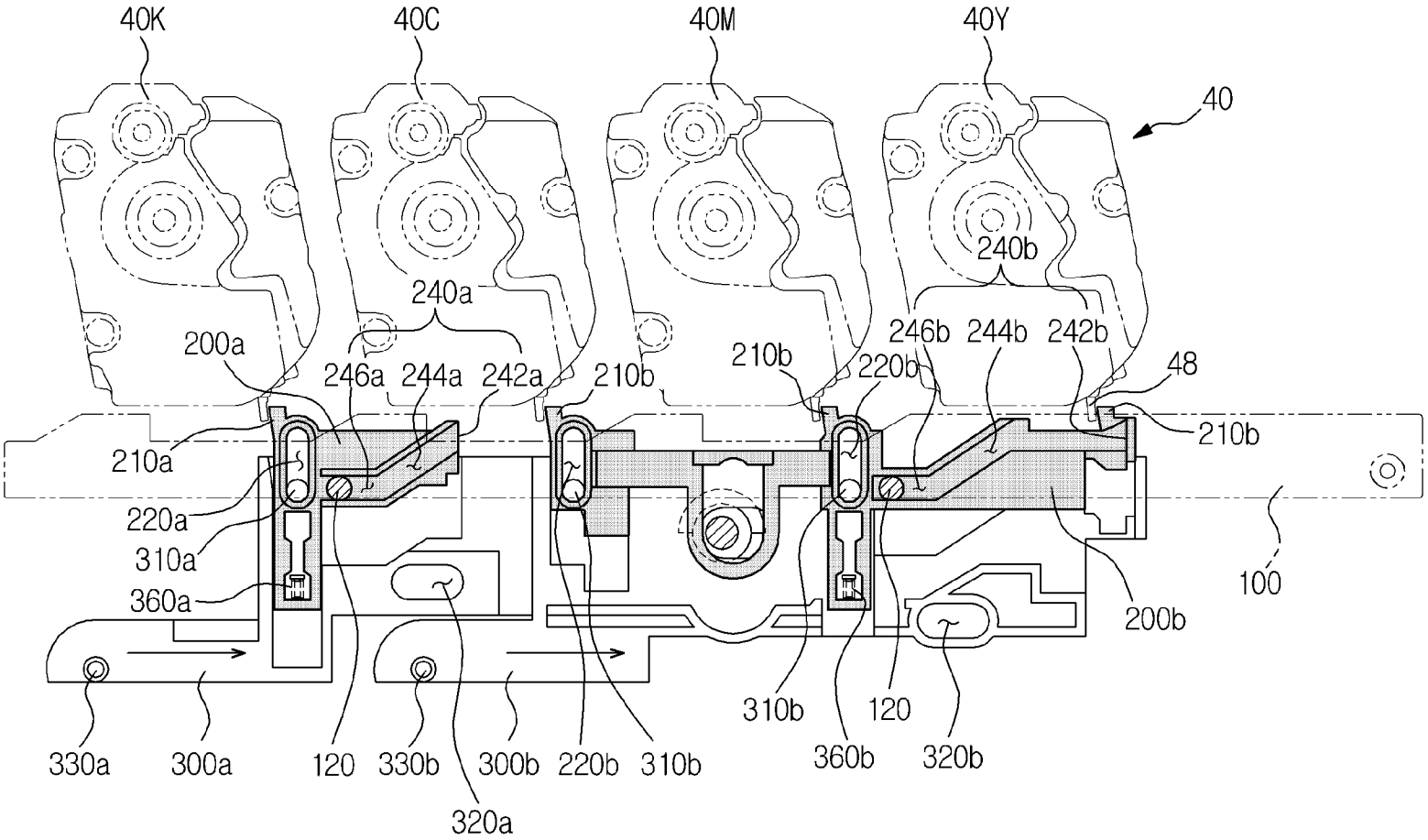
FIG. 17 is a view illustrating a state in which the developing cartridge is pressure-released according to an exemplary embodiment of the present general inventive concept.
Figure 18:
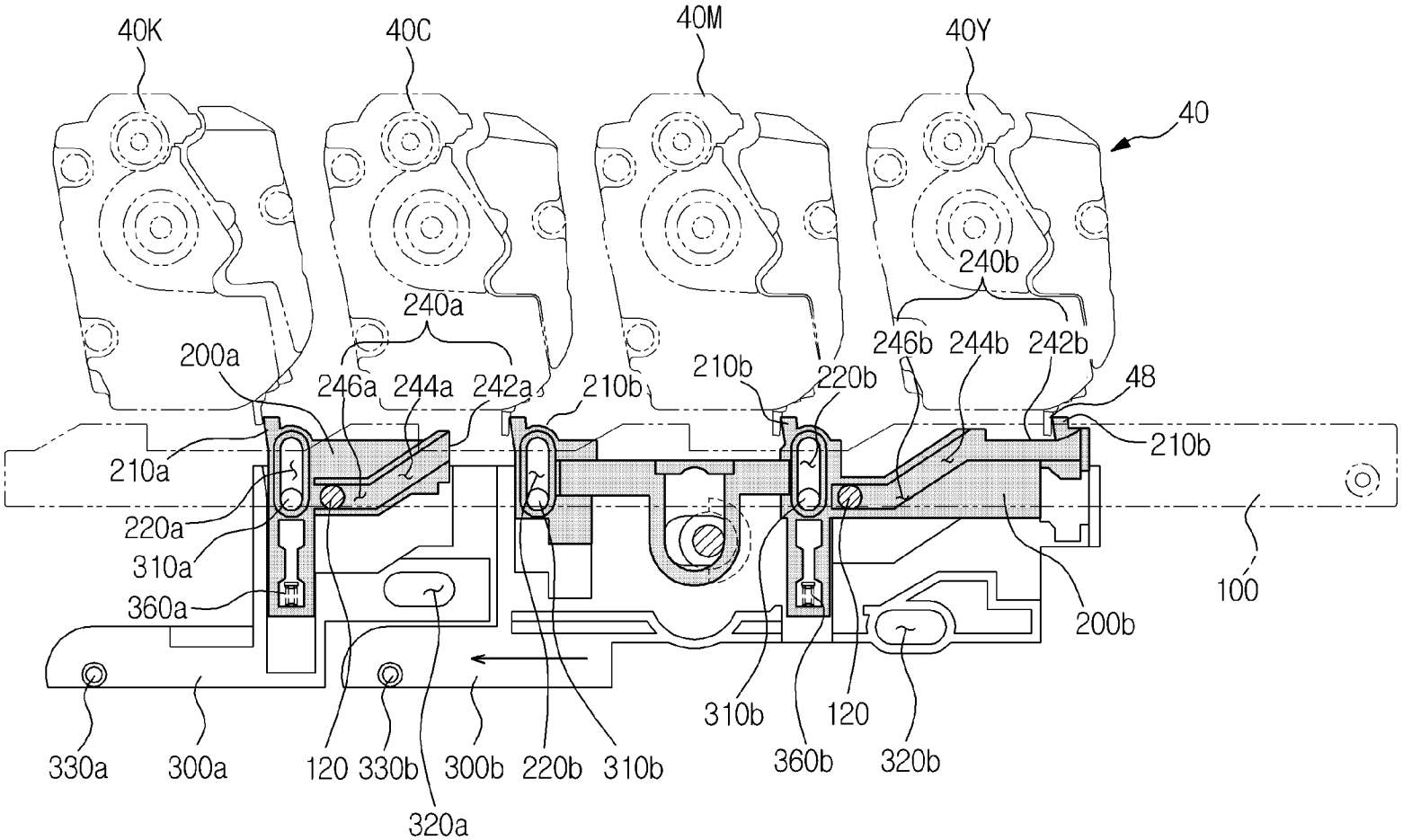
FIG. 18 is a view illustrating a state in which some developing cartridges are pressured by the second link members according to an exemplary embodiment of the present general inventive concept.
Figure 19:
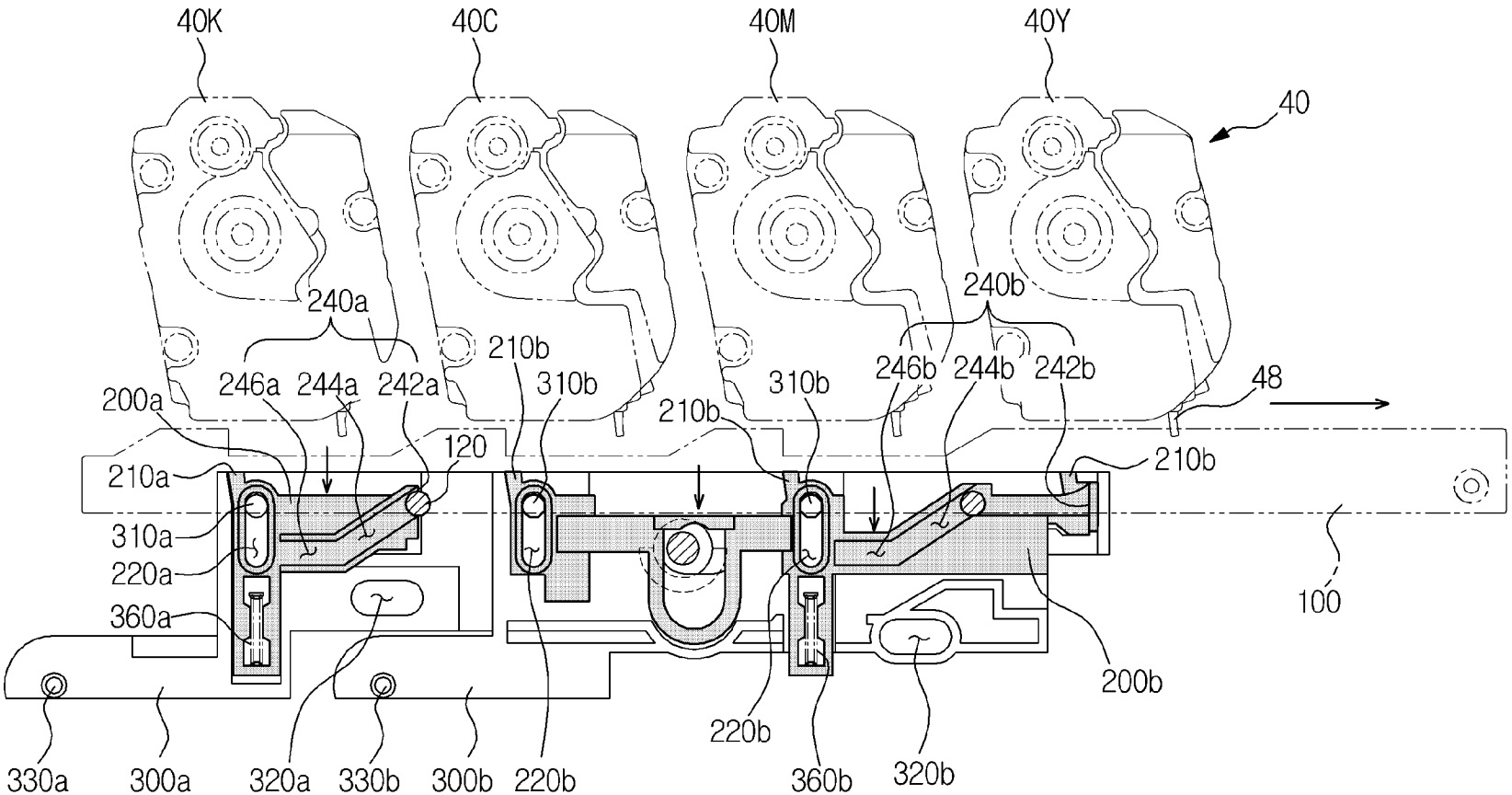
FIG. 19 is a view illustrating a positional relationship between the first link member, second link members and developing cartridge unit in a state in which the cover member opens the main body and reaches the first position according to an exemplary embodiment of the present general inventive concept.

FIG. 15 is a view illustrating a positional relationship between the first link member 100, second link members 200*a* and 200*b*, and the developing cartridge unit 40, in a state in which the tray unit 80 is completely mounted in the main body 10, FIG. 16 is a view illustrating a state in which the developing cartridges 40Y, 40M, 40C and 40K are pressed by the second link members 200*a* and 200*b*, and FIG. 17 is a view illustrating a state in which the developing cartridges 40Y, 40M, 40C and 40K are pressure-released. Also, FIG. 18 is a view illustrating a state in which some of the developing cartridges 40Y, 40M, and are pressed by the second link members 200*a* and 200*b*, and FIG. 19 is a view illustrating a positional relationship between the first link member 100, the second link members 200*a* and 200*b*, and the developing cartridge unit 40 in a state in which the cover member 11 opens the main body 10 and reaches the first position.

As illustrated in FIG. 15, in a state in which the tray unit 80 is completely mounted in the main body 10, the press protrusions 210*a* and 210*b* of the second link members 200*a* and 200*b* are positioned to press the respective developing cartridges 40Y, 40M, 40C and 40K.

As described above, since the surface constituent materials of the photoconductor 41 and the developing roller 43 may have different hardnesses, the component with the harder surface may deform the surface of the softer surface when the photoconductor 41 and the developing roller 43 come into contact with each other for an extended period of time. Therefore, it is necessary to separate the photoconductor 41 and the developing roller 43 from each other when the image forming apparatus 1 does not perform a printing operation (hereinafter, referred to as "ready mode").

As illustrated in FIG. 16, during the ready mode, the cam member 350, which connects the guide members 300*a* and 300*b* to each other, is rotated, causing the guide members 300*a* and 300*b* to move in a direction in which the developing cartridges 40Y, 40M, 40C and 40K are pressed. When the coupling bosses 342 are inserted into the guide slots 320*a* and 320*b*, the guide members 300*a* and 300*b* are moved in a direction parallel to a direction in which the tray unit 80 or the first link member 100 is moved. The support plate 340 having the coupling bosses 342, is attached to the main body 10 and thus, the guide members 300*a* and 300*b* supported by the coupling bosses 342 are fixed.

Simultaneously with movement of the guide members 300*a* and 300*b*, the second link members 200*a* and 200*b* coupled to the guide members 300*a* and 300*b* are moved in the same direction as the guide members 300*a* and 300*b*, and the press protrusions 210*a* and 210*b* provided at the second link members 200*a* and 200*b* press the bars 48 of the respective developing cartridges 40Y, 40M, 40C and 40K, causing the developing rollers 43 to be spaced apart from the photoconductors 41.

As illustrated in FIG. 17, when the image forming apparatus 1 performs a color printing operation (hereinafter, referred to as "color printing mode"), the cam member 350 is rotated by one-third turn in the ready mode, causing the guide members 300*a* and 300*b* to move in a direction in which the developing cartridges 40Y, 40M, 40C and 40K are pressure-released. Simultaneously with movement of the guide members 300*a* and 300*b*, the second link members 200*a* and 200*b* coupled to the guide members 300*a* and 300*b* are moved in the same direction as the guide members 300*a* and 300*b*, and the press protrusions 210*a* and 210*b* are spaced apart from the bars 48 so as to release pressure from the bars 48, causing the developing rollers 43 and the photoconductors 41 to come into contact with each other. As such, implementation of the color printing operation is possible.

As illustrated in FIG. 18, when the image forming apparatus 1 performs a mono printing operation (hereinafter, referred to as "mono printing mode"), the cam member 350 is rotated by one-third turn in the color printing mode, causing the guide member 300*b* to move in a direction in which some developing cartridges 40Y, 40M and 40C are pressed. Simultaneously with movement of the guide members 300*b*, the second link member 200*b* coupled to the guide member is moved in the same direction as the guide member 300*b*, and the press protrusions 210*b* provided at only one second link member 200*b* press the bars 48 of the developing cartridges 40Y, 40M and 40C, causing the developing rollers 43 to be spaced apart from the photoconductors 41. In the mono printing mode, the developing cartridge 40K in which containing black developer K is continuously released, similarly to the color printing mode, thereby allowing image printing using the black developer.

After completion of the printing operation based on the mono printing mode, as illustrated in FIG. 16, the cam member 350 is rotated by one-third turn in the mono printing mode, causing the guide member 300*a* to move in a direction in which the developing cartridge 40K is pressed. With movement of the guide member 300*a*, the second link member 200*a* coupled to the guide member 300*a* is moved in the same direction as the guide member 300*a*, and the press protrusion 210*a* of the second link member 200*a* presses the bar 48 of the developing cartridge 40K, causing the developing roller 43 to be spaced apart from the photoconductor 41. As such, the image forming apparatus 1 begins the ready mode.

If the printing operation is completed in the color printing mode, after the cam member 350 is rotated by one-third turn in the color printing mode to cause the guide member 300*b* to move in a direction in which some developing cartridges 40Y, 40M and 40C are pressed, the cam member 350 is again rotated by one-third turn, causing the guide member 300*a* to move in a direction in which the developing cartridge 40K is pressed.

Simultaneously with movement of the guide members 300*a* and 300*b*, the second link members 200*a* and 200*b* coupled to the guide members 300*a* and 300*b* are moved in the same direction as the guide members 300*a* and 300*b*, and the press protrusions 210*a* and 210*b* of the second link members 200*a* and 200*b* press the bars 48 of the respective developing cartridges 40Y, 40M, 40C and 40K, causing the developing rollers 43 to be spaced apart from the photoconductors 41. As such, the image forming apparatus 1 begins the ready mode.

If the cover member 11 is manually pulled forward with respect to the main body 10 such that the bars 48 are released from the press protrusions 210*a* and 210*b* when it is desired to exchange the developing cartridges 40Y, 40M, 40C and 40K, as described above, the cover member 11 and the first link member 100 connected to the cover member 11 slide forward with respect to the main body 10 in a state in which the tray unit 30 is fixed.

With movement of the first link member 100, the pressure pieces 120 of the first link member 100 slide along the oblique sections 244*a* and 244*b* of the guide rails 240*a* and 240*b* provided at the second link members 200*a* and 200*b*, causing the second link members 200*a* and 200*b* to move downward. Here, the second link members 200*a* and 200*b* are moved downward in a direction perpendicular to a movement direction of the pressure pieces 120. The pressure pieces 120 are located in the guide rails 240*a* and 240*b* until the cover member 11 opens the main body 10 and reaches the first position and then, are separated from the guide rails 240*a* and 240*b* when the cover member 11 is further moved beyond the first position.

If the cover member 11 is manually pulled forward with respect to the main body 10 until the cover member 11 is located at the first position, the second link members 200*a* and 200*b* are completely moved downward and are positioned such that the press protrusions 210*a* and 210*b* thereof do not interfere with the bars 48. Simultaneously with completion of the downward movement of the second link members 200*a* and 200*b*, as described above, the knock-up tray 84, which is used to secure the tray unit 80 to the main body 10, is separated from the main body 10 when the cover member 11 is located at the first position, which allows the tray unit 80 to be freely slidable forward with respect to the main body 10 without interference with the interior elements of the main body 10.

If the cover member 11 is further pulled forward from the first position, the sliding rod 16 of the cover member 11 presses one end of the slider 12 of the tray unit 80, causing the cover member 11 and the tray unit 80 to be simultaneously moved forward with respect to the main body 10. Then, if movement of the cover member 11 and the tray unit 80 is completed by a stopper (not illustrated), etc., as illustrated in FIG. 3, the respective cartridges 40Y, 40M, 40C and 40K accommodated in the tray unit 80 are completely exposed to the outside of the main body 10, allowing a user to separate one or more developing cartridges 40Y, 40M, 40C and 40K from the tray unit 80.

If the user replaces the developing cartridges 40Y, 40M, 40C and 40K and pushes the cover member 11 toward the main body 11 so as to again completely mount the tray unit 80 into the main body 10, the cover member 11 and the tray unit 80 are simultaneously moved toward the main body 10.

If the cover member 11 is moved toward the main body 10 and is located at the first position, the pressure pieces 120 are introduced into the guide rails 240*a* and 240*b* through the openings 242*a* and 242*b*. Then, as the cover member 11 is further moved from the first position toward the main body 10, the cover member 11 presses the oblique sections 244*a* and 244*b*, causing the second link members 200*a* and 200*b* to move upward toward the developing cartridges 40Y, 40M, 40C and 40K.

Once the cover member 11 closes the main body 10, the upward movement of the second link members 200*a* and 200*b* is completed and the press protrusions 210*a* and 210*b* are positioned to press the bars 48.

As is apparent from the above description, the exemplary embodiments of the present general inventive concept provide a developing cartridge with an improved mounting/separation configuration having a reduced number of elements, which reduces material costs and enhanced product production.

Furthermore, allowing a user to easily mount or separate the developing cartridge enables more convenient use.

Although the embodiment of the present general inventive concept has been shown and described, it would be appreciated by those skilled in the art that changes may be made in these embodiments without departing from the principles and spirit of the general inventive concept, the scope of which is defined in the claims and their equivalents.

What is claimed is:

1. An image forming apparatus, comprising:

a main body;

a developing cartridge unit provided in the main body to form an image;

a tray unit configured to accommodate the developing cartridge unit and movably mounted in the main body;

a first link member movably coupled to the tray unit; and a second link member provided in the main body to be moved according to a movement of the first link member, wherein the first link member includes a pressure piece to press the second link member such that the second link member does not interfere with the developing cartridge unit during movement of the first link member.

2. The image forming apparatus according to claim 1, wherein the second link member is pressed by the pressure piece and is moved upward or downward.

3. The image forming apparatus according to claim 2, wherein the first link member is coupled to one side or either side of the tray unit.

4. The image forming apparatus according to claim 3, further comprising:

a guide member provided at a lateral surface of the main body, wherein the guide member is arranged parallel to a direction in which the tray unit is moved, the guide member being coupled to the second link member to guide upward or downward movement of the second link member.

5. The image forming apparatus according to claim 4, wherein the guide member includes at least one guide protrusion protruding laterally from one side thereof, and the second link member includes at least one slot into which the guide protrusion is inserted.

6. The image forming apparatus according to claim 5, further comprising:

an elastic member provided between the second link member and the guide member to support the second link member.

7. The image forming apparatus according to claim 4, wherein the second link member includes at least one press protrusion to press the developing cartridge unit, and the press protrusion is provided at an upper end of the second link member.

8. The image forming apparatus according to claim 7, further comprising:

a cam member coupled to the guide member to move the guide member in a direction in which the press protrusion presses the developing cartridge unit.

9. The image forming apparatus according to claim 8, further comprising:

a cam gear connected to the cam member;

a cam drive gear engaged with the cam gear to transmit power to the cam gear; and a solenoid arranged near the cam drive gear to control driving of the cam drive gear.

10. The image forming apparatus according to claim 2, wherein the pressure piece protrudes from one surface of the first link member.

11. The image forming apparatus according to claim 10, wherein the second link member includes a guide rail to guide the pressure piece.

12. The image forming apparatus according to claim 11, wherein the guide rail includes:

an opening to allow the pressure piece to be introduced into the guide rail;

a parallel section extending parallel to a direction in which the pressure piece is moved; and an oblique section provided at an angle with respect to the parallel section.

13. The image forming apparatus according to claim 12, wherein the pressure piece slides along the guide rail and presses the oblique section so as to move the second link member upward or downward.

14. An image forming apparatus comprising:

a main body;

at least one developing cartridge including a photoconductor and a developing roller to feed developer to the photoconductor;

a cover member to open and close the main body;

a tray unit coupled to the cover member and slidably mounted in the main body to support the at least one developing cartridge;

at least one first link member provided at one side of the tray unit; and a second link member provided in the main body and having a guide rail to guide the first link member, wherein the first link member slides along the guide rail and presses the second link member.

15. The image forming apparatus according to claim 14, wherein the first link member includes a pressure piece protruding from a surface thereof.

16. The image forming apparatus according to claim 15, wherein one end of the guide rail is open to allow the pressure piece to be introduced into the guide rail, and the other end of the guide rail is provided with an oblique section at an angle with respect to a movement direction of the pressure piece to allow the second link member to be pressed by the pressure piece.

17. The image forming apparatus according to claim 16, wherein the second link member is moved upward when the pressure piece is introduced into the oblique section and is moved downward when the pressure piece is separated from the oblique section.

18. The image forming apparatus according to claim 14, wherein the cover member is slidably coupled to the tray unit, and the cover member has a first position at which the cover member moved forward of the main body is spaced apart from the main body by a predetermined distance in a state in which the tray unit is secured to the main body and a second position to which the tray unit and the cover member are moved together from the first position forward of the main body such that the at least one developing cartridge is separable from the tray unit.

19. The image forming apparatus according to claim 18, wherein a pressure piece is located in the guide rail until the cover member opens the main body and is located at the first position, and is separated from the guide rail when the cover member and the tray unit are moved together forward of the main body beyond the first position.

20. The image forming apparatus according to claim 18, wherein the second link member includes a press protrusion to press the at least one developing cartridge, causing the photoconductor and the developing roller to be spaced apart from each other, and the press protrusion is positioned to press the at least one developing cartridge when the cover member closes the main body and is positioned so as not to interfere with the at least one developing cartridge when the cover member is located at the first position.

21. The image forming apparatus according to claim 14, further comprising a guide member arranged parallel to a direction in which the first link member is moved, the guide member being coupled to the second link member to guide upward or downward movement of the second link member.

22. The image forming apparatus according to claim 21, wherein the second link member includes at least one vertically elongated slot, and the guide member includes at least one guide protrusion to slide along the slot.

23. A developing cartridge unit used in an image forming apparatus comprising a main body and a tray unit in which the developing cartridge unit to form an image is accommodated, the tray unit being movably mounted in the main body, the developing cartridge unit comprising:

a photoconductor;

a developing roller to feed developer to the photoconductor;

a bar to be pressed by a link member connecting the main body and the tray unit to each other such that the photoconductor and the developing roller are separated from each other when the bar is pressed and come into contact with each other when the bar is pressure-released; and a cam member to rotate according to a printing mode to cause the bar to be either pressure-released or pressed by the link member based on the printing mode.

24. The developing cartridge unit according to claim 23, wherein the link member includes:

a first link member coupled to one side or either side of the tray unit and having a pressure piece protruding from a surface thereof; and a second link member connected to the first link member and having a guide rail to guide the pressure piece, and wherein the pressure piece slides along the guide rail so as to press the second link member.

25. The developing cartridge unit according to claim 24, wherein the guide rail includes:

an opening provided at one end thereof to allow the pressure piece to be connected to the guide rail;

a parallel section extending parallel to a direction in which the pressure piece is moved; and an oblique section provided at a predetermined angle with respect to the parallel section.

26. The developing cartridge unit according to claim 25, wherein the pressure piece presses the oblique section to move the second link member in a direction perpendicular to a movement direction of the pressure piece.

27. The developing cartridge unit according to claim 26, wherein the second link member further includes a press protrusion to press the bar.

28. The developing cartridge unit according to claim 27, wherein the photoconductor and the developing roller are separated from each other when the press protrusion presses the bar, and come into contact with each other when the press protrusion releases the bar.

29. An image forming apparatus, comprising:

a main body, comprising:

at least one slot formed on a side of the main body, and at least one guide rail formed on the side of the main body; and a tray unit slidably mounted to the main body to hold at least one detachable developing cartridge, comprising:

at least one guide protrusion slidably coupled to the at least one slot, and at least one pressure piece slidably coupled to the at least one guide rail, wherein the at least one guide protrusion moves within the at least one slot in a first direction during a second directional movement of the at least one pressure piece within the at least one guide rail to separate the tray unit from the main body.

30. The image forming apparatus of claim 29, wherein the tray unit further comprises:

at least one developing cartridge, comprising:

a photoconductor to form an image thereupon, and a developing roller to press against the photoconductor to transfer developer onto a printing medium to form the image thereupon; and at least one bar coupled to the developing cartridge to separate the photoconductor from the developing roller.

31. The image forming apparatus of claim 30, wherein the main body further comprises at least one press protrusion to press against the at least one bar to perform the separation of the photoconductor from the developing roller.

* * * * *